United States Patent [19]

Hisey

[11] Patent Number: 4,534,280

[45] Date of Patent: Aug. 13, 1985

[54] CHIMNEY CAP

[75] Inventor: Durward A. Hisey, St. Louis, Mo.

[73] Assignee: Hy-C Company, Inc., St. Louis, Mo.

[21] Appl. No.: 545,229

[22] Filed: Oct. 25, 1983

Related U.S. Application Data

[62] Division of Ser. No. 357,733, Mar. 12, 1982, Pat. No. 4,436,021.

[51] Int. Cl.[3] ..... F23J 13/08

[52] U.S. Cl. ..... 98/67

[58] Field of Search ..... 98/59, 67, 83, 122

[56] References Cited

U.S. PATENT DOCUMENTS

| | | | |
|---|---|---|---|
| 44,182 | 9/1864 | Griffith | 98/67 |
| 197,150 | 11/1877 | Lichtenfels | 98/67 |
| 281,645 | 7/1883 | Rosenstar | 98/67 |
| 312,918 | 2/1885 | Steen | 98/67 |
| 377,508 | 2/1888 | Wright | 98/83 X |
| 841,660 | 1/1907 | Barnes | 98/67 |
| 1,622,431 | 3/1927 | Feigenbaum | 98/67 |
| 2,805,616 | 9/1957 | Roth | 98/67 |
| 2,976,796 | 3/1961 | Anthony et al. | 98/67 |
| 4,334,460 | 6/1982 | Simmons et al. | 98/67 |

*Primary Examiner*—Harold Joyce

*Attorney, Agent, or Firm*—Paul M. Denk

[57] ABSTRACT

In a chimney cap for providing coverage for the upper end of a chimney flue, the cap includes a cover, a band arranged therebelow, sufficient space in between the cover and band to allow the development of draft for removal of smoke and fumes, a foraminous screen arranged structurally between the cover and band, and retentioners, in the category of either tightening screws, or resiliently biasing appendages, operatively associated with the band for use for tightening of the cap within and to the chimney flue.

3 Claims, 8 Drawing Figures

CHIMNEY CAP

CROSS-REFERENCE TO RELATED APPLICATION

This application comprises a division of the application having Ser. No. 357,733, filed on Mar. 12, 1982, and now U.S. Pat. No. 4,436,021.

BACKGROUND OF THE INVENTION

This invention relates generally to an enclosure for the upper end of a chimney, but more specifically pertains a cap that provides sufficient coverage for preventing the entrance of the elements or wildlife into the chimney flue, without detracting from the development of the necessary draft required for drawing smoke and fumes from the chimney.

A variety of chimney covers or caps are available in the prior art. Most of these designs are of the type that include a form exterior strap that is used for tightening of a wire screen securly around the exterior upper edge of the chimney flue, and while these type of caps may serve their purpose for providing some degree of coverage for the upper end of the chimney flue, they do leave something to be desired with respect to the esthetics of their devices when located in place.

It is, therefore, the principal object of this invention to provide an improved chimney cap that not only enhances the draft of smoke and fumes from a chimney to the leeward, but provides a cap that is pleasing in appearance and can be easily inserted and installed for firmly securing upon the chimney head through the agency of retention means that can be rendered functional in a minimum of time.

Another object of this invention is to provide a chimney cap wherein its integral band means that envelopes the upper end of the flue incorporates retention means that can be immediately tightened in place but yet be sufficiently concealed from view after its installation.

Another object of this invention is to provide a chimney cap wherein the retention means includes appendages that can insert into and extend downwardly within the upper edge of the chimney flue, and yet be biased sufficiently in place for more permanent retention through the resiliency inherently designed into its retention means.

Still another object of this invention is to provide means for assuring precise positioning of the chimney cap upon its flue by incorporating shoulder means with the structure of its retentioners that limits the extent of application of the cap onto the chimney.

Still another object of this invention is to provide retention means for a chimney cap that bias at least at two points upon the interior of the chimney flue so as to assure that multiple pressure points guarantee that the cap shall remain in place upon the chimney regardless what type of inclement weather may be encountered.

Yet another object of this invention is to provide a chimney cap wherein its cover is displaced a sufficient distance heightwise from its chimney fastening band and structurally spaced apart by a foraminous means that yet allows the development of sufficient draft for removal of smoke and fumes from the chimney.

Another object of this invention is to provide a chimney cap that in one embodiment can be installed without the need for any other tools during its application.

Still another object of this invention is to provide a chimney cap which in one embodiment can be permanently installed, while only necessitating a single tool such as a screwdriver or wrench.

Yet another object of this invention is to provide a chimney cap that is thoroughly structurally stable in its construction, but yet retains enhanced beauty in its esthetics due to its mechanical applicators and retention means being sufficiently concealed from sight.

These and other objects will become more apparent to those skilled in the art upon reviewing the summary of this invention, and upon undertaking a study of the description of its preferred embodiment, in view of the drawings.

SUMMARY OF THE INVENTION

This invention relates to a chimney cap that is useful for application upon the upper edge of the flue of a chimney head, and one which has been designed containing sufficient inherent structure that allows for its ease of installation by the mechanic or even the home owner. The chimney cap of this design has desirably been constructed to yet retain all of those features desired from such a cover, in this particular instance attaining all of such results without sacrificing the structural integrity of the cover, or necessitating any supplemental metal or other material components that normally would otherwise detract from its appearance. The cover of this invention is designed to help protect the roof of the structure upon which the cap is installed from encountering exiting sparks, as from a fireplace, by incorporating a sufficient expanse of cover so as to prevent the rain or other elements from attaining entrance down into the chimney, which under other circumstances, may accumulate sufficiently so as to cause leakage into the fireplace, or in proximity of the furnace, and in addition, the structural make-up of this cap includes a foraminous screen or other member that totally precludes the entrance of birds, squirrels, or the like, from also attaining entrance into the chimney. In addition, even though all of the foregoing advantages for this invention are met from its structure, the cap does not detract from the development of sufficient draft surrounding the vicinity of the chimney head, so as to allow for total exiting of smoke and fumes from the chimney or the other operating instrumentalities with which it is associated.

The cap of this design does include an expanse of cover, being bevelled at its edges to assure the proper drainage of rain or other elements therefrom. Located a sufficient distance downwardly from the cover is a band means, being spaced therefrom by means of the aforesaid foraminous member, and which foraminous member is of sufficient structural strength so as to provide for the permanent retention of the cover heightwise with respect to the upper end of the flue. There is sufficient height between the chimney connecting band and the cap cover so that significant draft will develop to the leeward or laterally of the chimney top, which actually enhances the development of draft for attaining smoke discharge from the chimney, whereas, where such a cap is not employed, there is always the likelihood that wind can attain entrance substantially downwardly into the chimney and prevent development of sufficient draft for attaining its desired results. This latter detriment is particularly prevalent in those homes where the chimney is in close proximity or relationship with a sloping roof for the immediate or adjacent building with which the chimney is associated.

The band means of this invention includes various types of retentioners that may secure the cap snugly in place upon the upper end of the chimney flue. In one embodiment, the retention means includes a strap arranged interiorly of the cap band, and a series of fasteners, such as screws, threadedly engage either through the sides of the said band, or preferably at its corners, and when turned inwardly assure a tightening of the aforesaid strap and therefore its band snugly against the flue tile extending slightly upwardly of the chimney. The strap also includes means that prevents the too inward insertion of the flue within the cap during its installation, and this means includes a formed shoulder that may be bent laterally inwardly of the cap, within its band, so as to allow the flue to be inserted up to that point, and no further.

In another embodiment, retention means includes a series of appendages that extend downwardly from the sides of the band means, more preferably at its corners, and since the appendages are formed as legs, constructed of resilient material, they have a tendency to bind tightly against the interior surface of the contiguous flue, and assure a snug fitting of the chimney cap in place. An advantage of utilizing this type of an appendage for retention purposes is that, in this particular embodiment, each leg is formed having at its upper end an inwardly extending portion, which functions also as a shoulder to retard any further movement of the chimney flue therepast as when the cap is being installed in place upon the same.

DESCRIPTION OF THE PREFERRED EMBODIMENT

Figure 1:
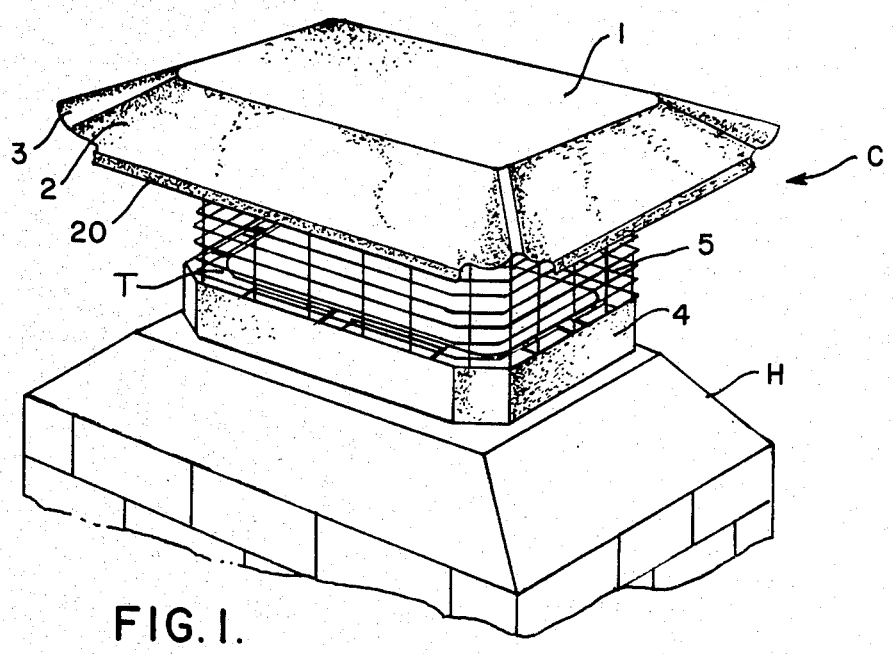
FIG. 1 provides an isometric view of the chimney cap of this invention located in place upon a chimney head.

In referring to the drawings, and in particular FIG. 1, there is disclosed the chimney cap C of this invention, shown in its mounting disposition upon the chimney head H of the chimney, and more specifically upon its upper extending flue tile T, which is concealed within the interior of the chimney cap of this invention.

The chimney cap includes a cover means 1 which is of sufficient expanse both lengthwise and widthwise, so as to prevent the elements such as rain, snow, or the like, from attaining access directly downwardly into the chimney flue. At its outer edges the cover means is beveled, as at 2, being slightly crimped at its ends, as at 3, which is done so simply to accommodate the pressing operation that attains beveling at this location for the formed cover or hood. Spaced downwardly, heightwise from the cover 1 is a band means 4, which is substantially continuous in design, being welded or otherwise secured together at its ends, and possesses interior dimensions only slightly greater than the exterior of the flue tile upon which the cap is to mount. It might be commented at this juncture that the flue tiles normally located within a designed chimney are of fairly standardized dimensions.

Arranged intermediate the cover means 1 and the band means 4 is a reasonably stiff foraminous member, in this particular instance containing large gauge screen or wire, as at 5, and which is designed for securing with the band means, along its interior, and also attaching onto the inner surface of the cover means, and thereby providing for this fixed spacing intermediate the said cover and band means, as previously mentioned.

Figure 2:
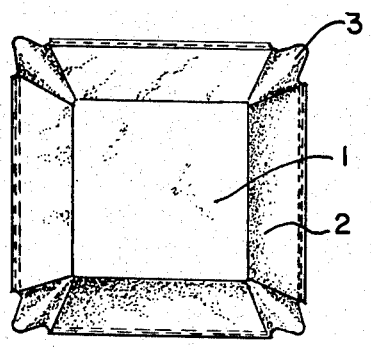
FIG. 2 provides a top view of the chimney cap shown in FIG. 1.

The construction of the cover means, and its shape from the plan view, is also shown in FIG. 2, disclosing its canted or beveled edges 2, with the inherently formed fluting at its corners, as at 3, which is simply provided for accommodating the pressed shaping of this cover means during its manufacture.

Figure 3:
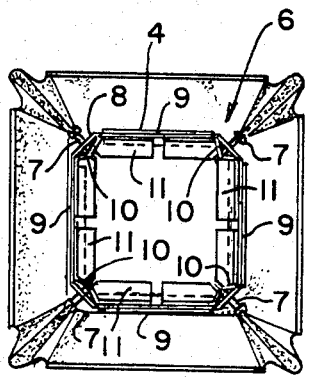
FIG. 3 provides a bottom view of the chimney cap shown in FIG. 1.
Figure 4:
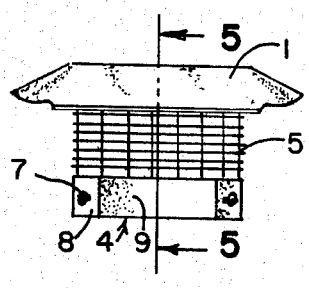
FIG. 4 provides a side view of the chimney cap shown in FIG. 1.

As can be seen in FIG. 3, which is a bottom view of the formed chimney cap, the retention means structure, as at 6, is provided approximately at each corner of the formed band means 4, and which furnishes that structural means for rigidly securing the cap to the chimney head during its installation, and in an expeditious manner as previously explained. Each retention means 6 includes a fastener, such as the screw or bolt 7, as shown, being threaded through their respective corners of the band means 4, and with each corner of the band means being slightly flattened, as at 8, in order to facilitate the arrangement of the retention means at these corner locations. This is complementary to the standard shape of the flue tile upon which this cap fits, and it is at this location where the said tiles possess their rounded edges and have their greatest strength. It might be stated, though, that it is just as likely that retention means of these type may also be located along the sides, as at 9, in order to attain securement of the chimney cap with the flue, and be effective for the purposes of this invention, but preferably these retention means will be located at the corners to assure a snugger and more sound fit of the cap upon its chimney. Provided inwardly at each corner of the band means 4 is a strap 10, which strap is secured at its ends to the interior surface of the said band means 4. The strap may be continuous around the inner periphery of the band means, or it may be comprised of corner segments that may be welded or otherwise secured at their ends to the interior of the band means, but yet remain free at the flattened corners, as can be seen, for purposes to be hereinafter described. Each strap means is flexible in design, generally constructed of a metallic material, and as the fasteners 7 are turned inwardly within the band means, through their threaded engagement, they bias against the strap means and cause its forcement further interiorly of the band means, and its eventual binding against the exterior surface of the chimney tile. Since the strap means are secured to the band means only at their ends, or approximately at the midpoints of the band sides 9, the straps are free to shift inwardly from their initial position contiguous the flattened corners of the band means, until such time as they tightly bias against the flue tile, as previously explained.

As can also be seen in FIG. 3, arranged some distance upwardly from the bottom edge of the band means 4 are a series of shoulders, as at 11, and which shoulders may also be welded to the interior surface of the band means 4, or its flattened sides 9, or which shoulders may be integrally formed with the strap means, bent approximately at a perpendicular therewith, and extend for some distance inwardly of the spacing within the band means 4 as can be seen. These shoulders 11 are arranged approximately one and a half to two inches upwardly from the bottom of the band means 4, and provides a sufficient distance for the chimney tile to insert within the band means before it comes to rest against said shoulders, at which time the retention means 6 can be tightened in place, and provide a sufficient distance for overlap of the chimney cap, or more specifically its band means, to assure a tight and snug fitting in a more permanent relationship of the chimney cap upon its flue.

Figure 5:
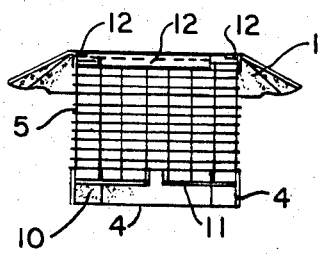
FIG. 5 provides a sectional view taken along the line 5—5 of FIG. 4 of the chimney cap of this invention.

As can also be seen in FIG. 5, the upper edges of the wire guard are secured to the interior surface of the cover means 1 by means of a series of angles 12 that are arranged around the interior of the said cover, and form a pocket in which the upper edge of the screen 5 may insert, and be welded or otherwise secured in place within the cap construction.

The installation of this embodiment of the chimney cap is relatively simply, necessitating only a sliding onto the upper end of the flue of the chimney head of the cap, and within its band means 4 up until the upper edge of the tile encounters the shoulders 11. When this occurs, the installer need simply to tighten the screws or bolts of the retention means 6 tightly in place, until the straps 10 come into tight contact with the exterior of the upper edge of said flue. Once this occurs, and all four of the fasteners are adjusted into tight positioning, the cap has been installed, and ready for prolonged usage.

Figure 6:
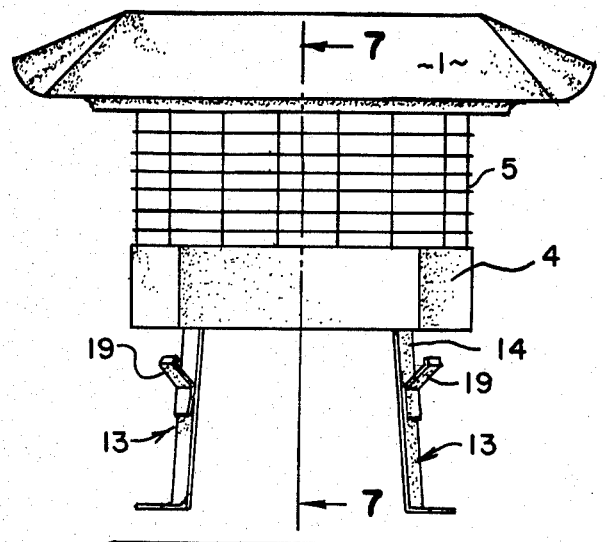
FIG. 6 provides a side view of the chimney cap of this invention showing a modification in its retention means for securing the cap upon a chimney head.
Figure 7:
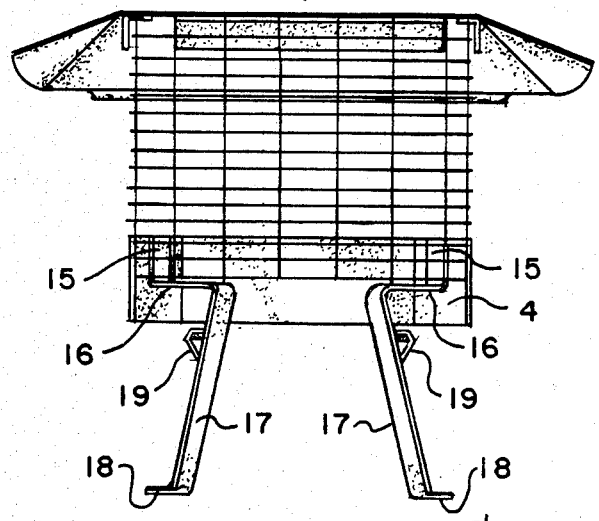
FIG. 7 provides a sectional view taken along the line 7—7 of FIG. 6, showing the modified retention means for the chimney cap of this invention.

A modification to the chimney cap of this invention is shown in FIG. 6, wherein the cover means 1, band means 4 and foraminous member 5 are all constructed identically to that previously explained, but the difference is provided in the type of retention means that is used for securing the chimney cap onto the chimney tile. It is to be noted that there are no fasteners threadedly engaged through the slightly flattened corners for the band means 4. In this particular instance, a series of appendages, as at 13, extend downwardly from approximate each corner of the band means 4, and each appendage, there being four in number associated with the cap, is formed as a multibent leg 14 in the manner as to be hereinafter described. Each leg has an upper extending portion 15 that is disposed for its welding to the interior of the band means 4, with said legs being bent approximately perpendicularily therewith, inwardly of the cap, as at 16, to therein form a shoulder against which the top of the chimney flue comes to rest after the cap has been fully inserted and installed. The leg then extends further downwardly, as at 17, and is angulated outwardly, in a manner as shown, until at its bottom ends, each legs is bent once again, as at 18, as can be seen. The disposition of the lower outwardly bent ends 18 of each leg is at a location that is arranged approximately in alignment with the band means 4, so that after the cap has been installed upon the chimney flue, the legs will be forced slightly inwardly to accommodate for the thickness of the flue tile upon which it mounts, and to present sufficient bias against the inner surface of said flue so as to more permanently secure the chimney cap in place. More of these flue tiles, as previously explained, are of standardized dimensions, being either of square or rectangular design that is predetermined to provide that capacity needed for removal of smoke and fumes from the size of fireplace or furnace to be serviced, and in addition, the thickness of each flue tile is also of a highly standard dimension. Thus, the design of these legs, and their arrangement with respect to the band means, can be fairly reasonably determined and manufactured into the finished product in order to assure that sufficient pressure will be exerted upon these resilient appendages against the interior of the chimney flue, to assure retention of the cap thereon. To provide for a double point pressure of each appendage 13 against the interior of the flue tile, it can be seen from both FIGS. 6 and 7 that tab means 19 are also secured or otherwise welded to each appendage 13, and has an outwardly extending portion that is sufficiently resilient so it likewise binds against the interior of the flue tile, during application and installation of the chimney cap thereon. The installation of this particular modified design for the chimney cap of this invention is likewise reasonably simple, in that two of the four appendages, along one side of the cap, are initially inserted into the flue tile, and then the other two appendages receive an exerting inward pressure on their lowest portions possible until such time as they also become inserted and located upon the interior surface of the same tile. Then, a pushing force directed straight downwardly upon the cap gradually forces the further insertion of the four appendages within the chimney flue or lining, until such time as the upper edge of said flue comes into contact with the formed leg shoulders or braces 16, at which time the cap will now be fully installed and ready for useful service.

Figure 8:
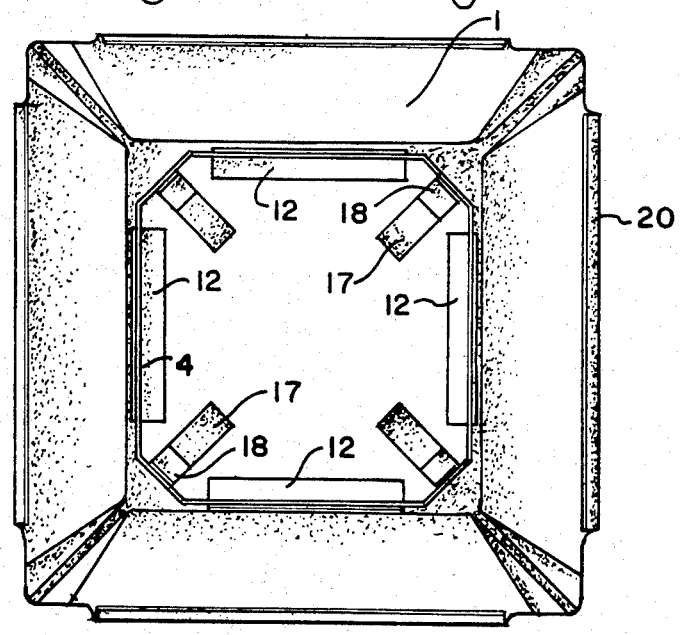
FIG. 8 provides a bottom view of the chimney cap shown in FIG. 6.

It may also noted with respect to FIGS. 1 and 8 that each cover means 1 includes a marginal lip, as at 20, integrally formed along each side of the said cover. This is formed also during the pressing operation, and is useful for furnishing further reinforcement to the formed cover.

Variations or modifications to the structure of the this invention may occur to those skilled in the art upon reviewing the subject matter of this invention. Such variations, if within the spirit of this invention, are intended to be encompassed within the scope of any claims to patent protection issuing hereon. The description of the preferred embodiment set forth herein is done so primarily for illustrative purposes only.

Having thus described the invention what is claimed and desired to be secured by Letters Patent is:

1. In a chimney cap for use in providing coverage for the upper end of the formed chimney flue and thereby preventing the entrance of any extraneous elements therein, comprising, a cover means provided upwardly of the cap and preventing the entrance of rain or elements downwardly into the chimney flue, a band means arranged downwardly of the cap and designed for proximity fitting upon the said chimney flue, said cover means and band means being spaced apart a distance heightwise to allow sufficient draft to develop and remove smoke and fumes from the chimney flue, a foraminous means arranged connecting with both said cover means and band means and disposed spanning the space between the said means and arranged substantially in alignment with the said band means, and retention means operatively associated with the said band means for assuring its securement with the chimney flue upon which it seats, said retention means including a series of appendages securing with the band means and projecting downwardly therefrom for extending into and biasing against the interior of the chimney flue for securement of the cap therewith, said band means being formed having a series of sides, adjacent sides of the band means being intervened by substantially flattened corners, there being an appendage connecting at each corner of the band means, each appendage being formed of resilient material, and each appendage including a leg that connects with the band means, being arranged contiguously with the interior of the band means, at each corner thereof, and extends inwardly and then downwardly to its lowest extent, each said appendage end arranged for biasing against the interior of the chimney flue for securing said cap firmly in place, with the inwardly extending portion of the leg of each appendage functioning as a shoulder means for contacting with the upper edge of the chimney flue to limit the extent of insertion of the chimney flue with the band means during installation of the said chimney cap.

2. The invention of claim 1 and wherein said cover means being bevelled around its periphery to facilitate drainage of the elements from the same.

3. The invention of claim 1 and including a tab means securing upon the downwardly extending portion of each leg means of an appendage, said tab means designed for alignment and also for biasing against the interior of the chimney flue for holding said cap firmly in place, wherein the combination of said downwardly disposed leg and the tab means for each appendage providing for a double point contact of each appendage with the interior of the chimney flue to assure the securement of the chimney cap in place.

* * * * *